United States Patent [19]

Schuster

[11] Patent Number: 4,967,910

[45] Date of Patent: Nov. 6, 1990

[54] RECLOSABLE SIDE-OPENING BOX

[76] Inventor: Fred Schuster, 40 Hampton Crescent, London, Ontario, Canada, N6H 2N8

[21] Appl. No.: 319,416

[22] Filed: Mar. 6, 1989

[51] Int. Cl.[5] ..... B65D 5/70

[52] U.S. Cl. ..... 206/621.4; 206/621.6; 206/621.7

[58] Field of Search ..... 206/621.1, 621.4, 621.6, 206/621.7, 626, 631.2, 621.3; 229/121, 125.09

[56] References Cited

U.S. PATENT DOCUMENTS

| | | | |
|---|---|---|---|
| 1,539,985 | 6/1925 | Allen | 206/621.4 |
| 2,324,807 | 7/1943 | Wentz | 206/621.7 |
| 2,352,424 | 6/1944 | Derieg | 206/621.7 |
| 2,417,104 | 3/1947 | Cope | 206/621.7 |
| 2,725,173 | 11/1955 | O'Reilly | 229/121 |
| 2,760,708 | 8/1956 | Phillips | 206/621.4 |
| 4,194,677 | 3/1980 | Wysocki | 206/621.4 |
| 4,650,078 | 3/1987 | Desmond et al. | 206/621.7 |

FOREIGN PATENT DOCUMENTS

| | | | |
|---|---|---|---|
| 546884 | 10/1957 | Canada | 206/621.3 |
| 562653 | 9/1958 | Canada . | |
| 1106298 | 8/1981 | Canada . | |
| 1188255 | 6/1985 | Canada . | |
| 1232247 | 2/1988 | Canada . | |
| 2532159 | 2/1976 | Fed. Rep. of Germany | 206/621.3 |
| 504012 | 4/1939 | United Kingdom | 229/125.09 |
| 565842 | 11/1944 | United Kingdom | 206/621.3 |
| 1203772 | 9/1970 | United Kingdom | 206/621.3 |

*Primary Examiner*—Gary E. Elkins

*Attorney, Agent, or Firm*—St. Onge Steward Johnston & Reens

[57] ABSTRACT

An improved container with a reclosable pour spout which can be inexpensively manufactured by using box board without the necessity of a special metal spout or foil linings is disclosed. A perforation in the inner wall defining a plug and outlining a spout remains attached to the inner wall during shipping. During use it is detached from the inner wall by pulling a flap which serves as a spreader forwardly and downwardly in the outer wall. The spreader is disposed horizontally below the pour spout, and serves to evenly distribute the contents of the container. When the container is not in use, the spreader is pushed back in shipping position, and the plug is secured in the inner wall, thereby decreasing the possibility of spillage.

2 Claims, 2 Drawing Sheets

RECLOSABLE SIDE-OPENING BOX

BACKGROUND OF THE INVENTION

This invention relates to containers and particularly containers with reclosable pour spouts used for particulate dry substances such as laundry soap, salt, or chemical herbicides. Numerous containers with reclosable pour spouts are known in the art. Particularly pour spouts made out of aluminium such as those used on boxes containing salt or sometimes sugar are known. One of the problems with such containers is that they are very expensive to manufacture as an inner foil or metallic backing must be used along with the box or paper board in the production process.

The problem with those containers made solely from box board, is that none of the known containers provide a satisfactory reclosable, sealable pour spout package which can be used many times without wear.

SUMMARY OF THE INVENTION

The present invention seeks to provide a container made completely out of box board which has a pour spout which can be firmly reclosed. The pour spout also allows for a graduated flow due to the tapered sides of the spout. The present invention also provides a flat spreader which can evenly distribute the particulate contents of the container over a small area.

Therefore this invention seeks to provide a container with a reclosable spout comprising an outer wall and an inner wall; wherein said outer wall comprises a rectangular flap means with three perforated sides and a fourth folding side defining a hinge; and said inner wall includes perforations defining a plug; said perforated plug being fixedly attached to said rectangular flap means during assembly; and said outer wall and said inner wall also being securely attached to one another during assembly (except where said flap means of said outer wall abuts said inner wall;) whereby when, in operation, said rectangular flap means is pulled outwardly and downwardly about said hinge said plug is detached from said inner wall thereby defining an opening to provide a pour spout.

In a preferred embodiment a box board blank having five sides is creased thereby creating folds between the five sides. A rectangular flap means and thumb aperture are perforated in the first side while a perforation defining a plug, which eventually becomes a pour spout, is stamped on the fifth side. The box board blank has end flaps on each end of four sides. These are later glued in a conventional manner during assembly. To assemble the box board blank the fifth side is folded under the first side by a standard folder gluer machine such that the perforation defining a plug is located immediately behind the middle of the flap means.

The lower end flaps are then folded and glued thereby creating an upright vertical four sided box.

The container is then filled with product of a dry nature, preferably in the nature of particulate and the upper end flaps are folded and glued in place. The container is then shipped for distribution to the consumer. Until use, the perforated flap means remains in place and the plug remains secured within the fifth side or inner wall.

When the consumer wishes to use the contents of the carton a thumb nail placed in the aperture above the flap means is used to pull the flap downwards and forwards thereby detaching it from the outer wall. (Because the perforated plug on the inner wall is glued to the flap means), this action also detaches the plug from the inner wall thereby forming a pour spout.

In a preferred embodiment the pour spout has an upper edge in the form of saw teeth with descending upper sides and tapered bottom sides. The tapered pour spout is used to control the amount of flow of the product.

When the consumer is finished using the product on any particular occasion the flap means can be pressed upwardly and inwardly and the plug reattaches itself into the inner wall keeping a substantially sealed fit. The pour spout can be used over a succession of times and always maintains its locking abilities at least until the contents of the package are used.

BRIEF DESCRIPTION OF THE DRAWINGS

The invention will now be described in more detail in conjunction with the following drawings wherein.

DETAILED DESCRIPTION ON THE INVENTION

Figure 1:
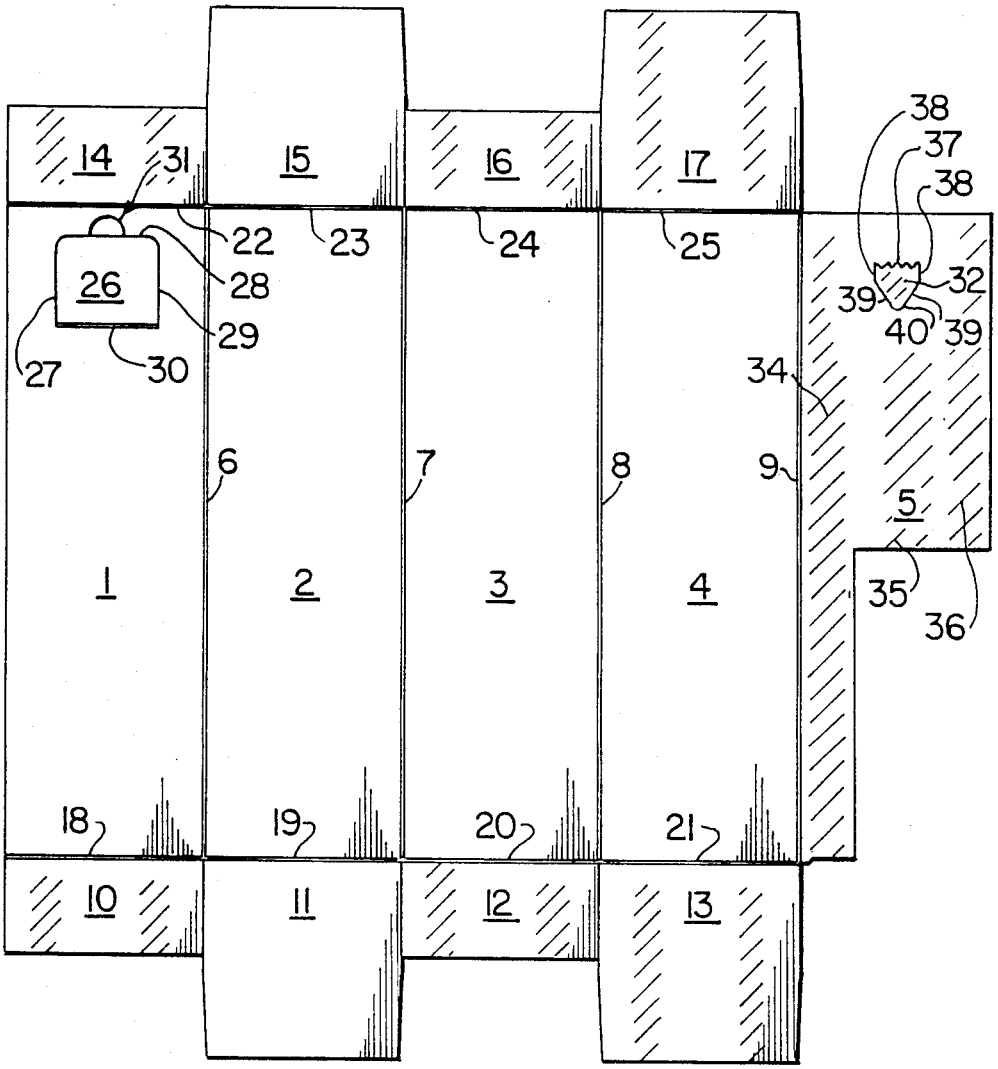
FIG. 1 is a box board blank before assembly.

In FIG. 1 one sees a box board blank which is a preferred embodiment of the invention. The box board is as it appears after it has passed through a die cutter and creaser machine. It has five rectangular sides, a first side 1, a second side 2, a third side 3, a fourth side 4, and a fifth side 5. Folds between the 5 sides are numbered as 6, 7, 8, and 9. On the top and bottom of side 1 there are end flaps 10 and 14. Between side 1 and said flaps 10 and 14 are folds 18 and 22.

On the top and bottom of side 2 end flaps 11 and 15 are shown separated from side 2 by folds 19 and 23. One notes that the end flaps on side 2 are approximately twice as long as those of side 1.

Side 3 has end flaps 12 and 16 which are substantially the same length as end flaps 10 and 14. End flaps 12 and 16 are separated from side 3 by folds 20 and 24.

Side 4 has end flaps 13 and 17 which are substantially the same size as flaps 11 and 15. Again folds 21 and 25 are found between side 4 and the end flaps 13 and 17.

In this embodiment side 5 does not have the same area as the other 4 sides. The full width equal to the other four sides spans only the top portion of side 5, whereas the width is substantially less on the lower portion. This is simply a saving of box board as it is irrelevant whether the bottom portion of side 5 is the same width as, or smaller than, the upper portion.

Adjacent the top of side 1 and substantially midway between the two side edges is a rectangle 26. During die cutting it is perforated along three sides 27, 28, and 29. A semicircular aperture 31 is cut out above the rectangle. The rectangle 26 is destined to be used as a flap which during usage is hingably attached to side 1 by means of fold 30.

On side 5 is a perforation defining a plug 32. It has an upper saw tooth edge 37, upper sides 38, and tapered lower sides 39 ending at bottom 40. The perforation defining the plug 32 is destined to become a pour spout after assembly and during usage.

During assembly glue is applied to flaps 10, 12, 14, 16, 13, and 17 and on side 5 on lines 34, 35, and 36. The perforation defining a plug 32 also has glue applied to it.

Figure 2:
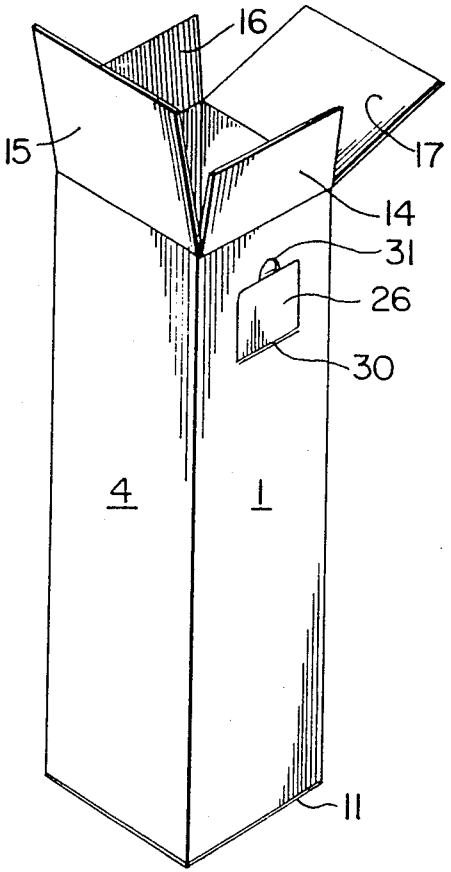
FIG. 2 is a perspective view of an assembled box with the upper end flaps in the open position in preparation for filling of product.

FIG. 2 is a view of an assembled box which is the subject of the invention. Side 5 has been folded behind and glued to side 1 thereby forming a rectangular box with sides 1, 2, 3, and 4 showing. Side 1 therefore has an outer wall 1 and an inner wall 5 (not showing except behind aperture 31). Bottom flaps 10, 11, 12, and 13, are folded and glued in a conventional manner.

Figure 4:
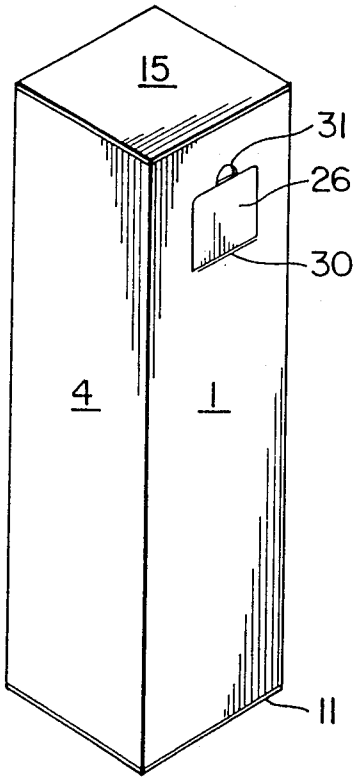
FIG. 4 is a perspective view of the box showing the reclosable spout in the closed position.

The box is filled with its contents prior to the closing of the top end flaps 14, 15, 16, and 17. The box is then shipped with its contents to the consumer with flap means and spreader 26 in the closed upright position as shown in FIG. 4.

Figure 3:
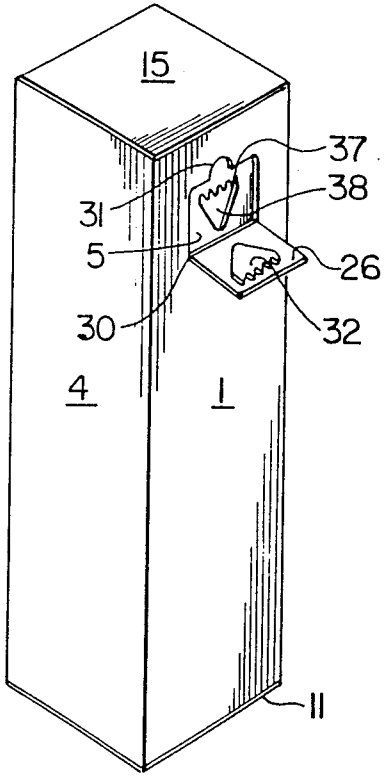
FIG. 3 is a perspective view of the box after it has been opened by the consumer showing the reclosable spout in the open position.

FIG. 3 illustrates the container with the pour spout open. To open the container a thumb nail is inserted in aperture 31 and flap 26 folds downward, around folded hinge 30. On the initial opening this movement (breaks the perforations along lines 27, 28, and 29). This operation also causes perforated ( ) a plug 32, which is glued to flap 26, (to detach from side 5 thereby producing an aperture or pour spout 38.

When the consumer wishes to use some of the contents of the box, it is tilted in a forward direction, and depending upon the angle, the amount of flow of particulate or contents of the box is determined.

If the consumer wishes to have the particulate such as in chemical herbicides spread over a small area the flap means 26 is allowed to remain in a substantially horizontal position, thereby spreading the particulate of the contents of the box as it emerges from the spout.

If one does not wish the contents of the box to be spread, the hinge means 26 can be held downwardly by means of a thumb and the contents flow directly from the pour spout.

FIG. 4 illustrates the spout and flap in the closed position. When the consumer wishes to close the package and block the spout 38, the flap 26 is simply pressed upwardly and inwardly and the plug 32 is pressed back into position in side 5. The plug remains closed by the latching action of saw toothed edge 37.

The reclosable spout package can be used in many applications and need not be in the form as shown. For example, a cylindrical container could be used having an inner wall and an outer wall. Thumb nail aperture 31 is not essential to the invention as long as the flap means can be pulled forwards to break the perforation. Furthermore the spout may be of any configuration which is suitable for the contents of the package.

What I claim as my invention is:

1. A die-cut box board for assembling an upright four sided box having a reclosable spout operable to control the amount of and to substantially evenly distribute particulate contents comprising:

five adjacent sides separated by first folds, each side having a top and a bottom;

four of the five adjacent sides having end flaps attached at the top and bottom thereof, the end flaps separated from the four adjacent sides by second folds;

a first of the five adjacent sides having three substantially straight die-cut perforations and a hinge fold defining a rectangle flap, the hinge fold located at the bottom of the rectangle flap, the rectangle flap located near a top and substantially in the middle of the first adjacent side, and the rectangle flap outwardly and downwardly foldable to form a spreader for substantially evenly distributing the particulate contents;

a fifth of the five adjacent sides having a die-cut perforation defining a substantially triangular plug, the substantially triangular plug located near the top and in the middle of the fifth adjacent side such that the substantially triangular plug will be substantially centered on the flap when the box board is erected, the substantially triangular plug forming a spout having an upper saw tooth edge for enhancing reclosability of the spout and having inwardly tapering sides for regulating the amount of flow of particulate contents.

2. A container having an integral reclosable spout operable to control the amount of and to substantially evenly distribute particulate contents dispensed therefrom comprising:

five adjacent panels separated by first folds, each panel having a top and a bottom;

four of the five adjacent panels having end flaps attached at the top and bottom thereof, the end flaps separated from the four adjacent panels by second folds;

a first of the five adjacent panels having three substantially straight die-cut perforations and a hinge fold defining a rectangle flap, the hinge fold located at the bottom of the rectangle flap, the rectangle flap located near a top and substantially in the middle of the first adjacent panel, and the rectangle flap outwardly and downwardly foldable to form a spreader for substantially evenly distributing the particulate contents;

a fifth of the five adjacent panels having die-cut perforations defining a substantially triangular plug, the substantially triangular plug located near the top and substantially in the middle of the firth adjacent panel the substantially triangular plug forming a spout having an upper saw tooth edge for enhancing reclosability of the spout and having tapering sides for regulating the amount of flow of particulate contents;

the first and fifth panels securely attached together to provide four container walls, the first and fifth panels further securely attached together such that the substantially triangular plug will be substantially centered on and adhered to an inner side of the flap; and the bottom end flaps securely attached together to provide a bottom container wall.

* * * * *